US005893679A

United States Patent [19]

Durand et al.

[11] Patent Number: 5,893,679

[45] Date of Patent: Apr. 13, 1999

[54] PROCESS AND A MACHINE FOR THE IMPLEMENTATION OF A BONDING LAYER AND ROAD-TYPE COATING COMPRISING SUCH A LAYER

[75] Inventors: Graziella Durand, Bois Colombes; Pierre Montmory, Pruney en Yvelines, both of France

[73] Assignee: Colas S.A., Cedex, France

[21] Appl. No.: 09/005,761

[22] Filed: Jan. 12, 1998

Related U.S. Application Data

[63] Continuation of application No. 08/622,831, Mar. 27, 1996, Pat. No. 5,769,567.

[30] Foreign Application Priority Data

Mar. 28, 1995 [FR] France ..... 95 03636

[51] Int. Cl.[6] ..... E01C 3/00; E01C 19/00

[52] U.S. Cl. ..... 404/108; 404/111; 427/138

[58] Field of Search ..... 106/277, 278; 252/311.5; 404/75, 111, 101, 108, 17, 82; 427/136, 138; 524/59, 60, 61

[56] References Cited

U.S. PATENT DOCUMENTS

| | | | |
|---|---|---|---|
| 4,302,128 | 11/1981 | Thatcher . | |
| 4,657,595 | 4/1987 | Russell | 106/277 |
| 4,684,289 | 8/1987 | Gnesa . | |
| 4,948,431 | 8/1990 | Strickland et al. . | |
| 5,268,029 | 12/1993 | Demangeon et al. . | |
| 5,270,373 | 12/1993 | Wiercinski et al. . | |
| 5,468,795 | 11/1995 | Guder . | |
| 5,503,871 | 4/1996 | Blacklidge et al. . | |
| 5,544,972 | 8/1996 | Boldt . | |
| 5,578,118 | 11/1996 | Shuey et al. . | |
| 5,670,562 | 9/1997 | Schilling . | |
| 5,769,567 | 6/1998 | Durand et al. | 404/75 |

FOREIGN PATENT DOCUMENTS

| | | |
|---|---|---|
| 0478441 | 4/1992 | European Pat. Off. . |
| 2680806 | 3/1993 | France . |
| 642411 | 1/1979 | U.S.S.R. . |
| 2167975 | 6/1986 | United Kingdom . |

*Primary Examiner*—James Lisehora
*Attorney, Agent, or Firm*—Greenblum & Bernstein, P.L.C.

[57] ABSTRACT

A process and a machine for forming a bonding layer for bonding a bituminous coated material layer on a support. The process includes application of a surface-active agent on the support, application of a bituminous emulsion on the surface-active agent on the support, and application of a breaking agent on the bituminous emulsion to form the bonding layer. A road-type coating made by the process and, therefore, including such a support layer, a bonding layer on the support, and a bituminous coated materials layer on the bonding layer. To perform the process, a machine includes a frame, a displacement mechanism on the frame, a bituminous-emulsion spreader on the frame, a surface-active agent applicator on the frame, and a breaking agent applicator on the frame.

6 Claims, 1 Drawing Sheet

PROCESS AND A MACHINE FOR THE IMPLEMENTATION OF A BONDING LAYER AND ROAD-TYPE COATING COMPRISING SUCH A LAYER

CROSS REFERENCE TO RELATED APPLICATIONS

This application is a continuation of application Ser. No. 08/622.831, filed Mar. 27, 1996, now U.S. Pat. No. 5,769, 567. The entire disclosure of application Ser. No. 08/622, 831 is considered as being part of the disclosure of this application, and the entire disclosure of application Ser. No. 08/622.831 is expressly incorporated by reference herein in its entirety.

BACKGROUND OF THE INVENTION

1. Field of the Invention

The invention relates to the formation of road-type coatings and pertains more specifically to a process of obtaining a bonding layer enabling the gluing of a layer made of bituminous coated materials onto a support.

The invention also relates to a road-type coating comprising a bonding layer obtained by the process.

The invention relates furthermore to a road making machine allowing the implementation of this process.

2. Discussion of Background

The production of a road-type coating results from the formation of successive layers. Among the various layers, at least one bituminous layer covers an inferior layer, so-called supporting layer. The nature of the supporting layer can be quite varied, concrete, cobble stones or bituminous coatings for instance. The condition of this support can also be subject to many variations. The support may be new or old, poor or sweating, rough or smooth, damp or dry, dusty or not, etc.

A bonding layer ensures proper gluing between the bituminous layer and its support. The bonding layer also guarantees the impermeability of the roadway. Generally, one avoids making the layer from an anhydrous bonding material which exhibits a risk of trapping fluxes between both layers situated on either side and which requires small amounts of bituminous bonding material which are incompatible with conventional spreading means: 300 to 600 grams of residual bitumen per square meter.

According to certain embodiments, the roadway comprises several successive layers of coated materials. These layers are linked together by a bonding layer. The inferior layer of coated materials thus serves as a supporting layer, for the bonding layer.

In some cases, the superior layer of the roadway may exhibit a superficial coating. This coating may provide certain surface qualities, such as roughness and impermeability, which the coating might have lost due to wear and tear. The coating layers are made of carbohydrated bonding materials, fluidized for spreading, either in an aqueous emulsion form or by adding to the bituminous small fractions of oil or coal distillation. The coatings may be anhydrous coatings, mixtures of bitumens and carbohydrated products.

Many studies have stressed the importance and the necessary proprieties of the bonding layer. Bonding layers of insufficient quality generate separation phenomena of the layers composing the roadway. This frequently encountered phenomenon requires heavy and expensive maintenance. Industry standards specify that the bonding layer must be regular and continuous and should never be sanded.

This bonding layer is generally composed of an alkaline emulsion of pure bitumen or of modified bitumen. The usual dosages recommended range between 300 and 600 g of residual bitumen per square meter. The dosage depends on the condition of the support and on the nature of the coated materials employed.

At present, there are several methods for forming a bonding layer.

According to one conventional method, an emulsion layer is deposited by a spreading machine, comprising a tank and a spreading ramp. The application is performed over a few dozen, sometimes a few hundred meters, ahead of an implementation workshop and the depositing of a bituminous coated material.

This method, although quite current, is only marginally satisfactory and exhibits many shortcomings. The breaking duration of the emulsions used generally exceeds 30 minutes, so that the tires of the trucks supplying the yard with materials, travelling on the fresh layer, reduce the thickness of the layer in some places and cause pollution by spreading bitumen to the roads the trucks take later. On the other hand, portions of the bonding layer are carried away by the caterpillars of the finisher travelling on the bonding layer, which finisher serves to deposit the layer made of coated materials. This premature degradation of the bonding layer causes the emulsion to resurface through the coated material in some places leading to glazing of the coated surface.

When the support exhibits poor cohesion, plate-like separation of the bonding layer, catching some of the supporting elements, leads to the formation of holes and bumps. In all cases, the defect in the bonding layer between both layers made of bituminous materials also causes very irregular and in sufficient gluing of those layers with respect to one another.

It has been suggested, for some years, to use devices associated with the finisher, which enable application of the bonding layer just before the coated material. However, this method also shows many shortcomings.

When the spreading means are arranged at the front of the finisher, the wheels or the caterpillars of the mobile assembly will circulate on the freshly spread layer, thereby causing deterioration of the layer. Besides, since the finishers are designed for producing coatings of roadways of variable breadth, a device fitted with adjustable ramps should therefore be provided. Moreover, the displacement velocity of finishers (3 m/min to 6 m/min) is much slower than the velocity of classic spreaders (30 m/min to 150 m/min). Consequently, the flow rate of the bonding material must be suited accordingly. The combination of those conditions yields a complex ramp arrangement, and delicate adjustment conditions, which are unlikely to yield homogeneous bonding layers.

This method also causes procurement difficulties of the various materials, on the vehicles, whose re-supplying is not always synchronized.

According to this method, the emulsion is dried and broken in a very short time, by contact of the bonding layer with the hot coated materials. Consequently, the bonding layer thus obtained cannot be controlled from either a quantitative or a qualitative viewpoint.

It has also been suggested to form a bonding layer by depositing thin capsules containing an anhydrous bituminous bonding agent. These capsules contain a husk made of solid material, stable at room temperature, which melt and vanish at the temperature of the applied coated material in order to release the bonding agent. This idea is quite tricky to implement and does not enable homogeneous distribution of the bonding layer over the whole surface of the support.

In particular, poor gluing causes systematic weakness in the structure of the roadway and faster fatigue deterioration.

SUMMARY OF THE INVENTION

The purpose of this invention is to avoid these shortcomings. The present invention also aims at making a process available which enables rapid breakdown of the bituminous emulsion to minimize gluing residues which stick to the tires of procurement vehicles and of vehicles which would have to drive accidentally on this freshly spread layer. The method further provides good resistance to the passage of the finisher's caterpillars. Still further, the method allows adapting the viscosity of the bonding agent of the emulsion used to local climatic conditions, ensuring perfect gluing of the bonding layer to the support and, more especially when the support is damp, and finally offering the possibility of performing quality and quantity checks on the gluing layer employed.

One of the targets of the invention is to be able to use the road-type coating, comprising a bonding layer obtained by this process.

Another objective is to provide a machine for the construction of roadways enabling the implementation of this process.

The invention relates to a process for obtaining a bonding layer, and to a layer made of bituminous coated materials on a support formed by spreading a bituminous emulsion. According to the invention, the process comprises the following steps:

application of a surface-active agent on the support, application of the bituminous compound, and application of a breaking agent.

The application of the surface-active agent on the support leads to significant improvement of the adherence of the bonding layer on the support, whatever its nature and its condition. The emulsion used is either a purely bituminous emulsion, or a polymer-modified bituminous emulsion. This emulsion does not contain any fluxes. This characteristic prevents fluxes from resurfacing through the coated material. This upward motion of fluxes tends to soften the binding agent of the surface coated material and thus to bring forth sweating areas, wheel tracks or holes, due to traffic.

Other technical characteristics can be combined in order to obtain specific advantages.

In the most common case of cationic emulsions, the breaking agent is projected onto the bituminous emulsion brush falling from the spreader.

Generally, the breaking agent is projected onto the bituminous emulsion, in this particular case, the breaking agent solution is projected simultaneously to the bituminous emulsion falling from the spreader. This arrangement, although preferred, is not required. It allows the bituminous emulsion to be broken inside the mass of the overall compound.

The bituminous emulsion contains a binding agent whose weight proportion ranges between 40 and 70%.

The bitumen used for the emulsion is chosen among classes 180/220, 70/100, 60/70, 35/50 and 25/35. This process may involve a hard bituminous emulsion. The choice of the emulsion used may consider climatic, temperature and hygrometric conditions, in relation to the period and the location of the process.

In the case of cationic emulsions, which is the most common, the breaking agent used is an aqueous solution, with at least one of the products taken from the list of strong bases, anionic surface-active agents and anionic polymers. When using an anionic emulsion, the breaking agent used is an aqueous solution with at least one of the products in the list of strong acids, cationic surface-active agents and cationic polymers, for instance of ammonium quaternary type. The application of the breaking agent enables rapid solidification of the bonding layer. This phenomenon prevents the layer from adhering to the tires of the vehicles which might have to travel on the layer. This absence of a gluing process from above is also praised by personnel entrusted with the operations. The working site is therefore cleaner.

According to a preferred solution, the breaking agent is an anionic polymer, which because of its charge and its long chain molecular structure, fosters the agglomeration of bitumen particles. Anionic polymer refers to acrylic acid-based polymer or copolymer salts, for instance a soda, ammonium or potassium polyacrylate, or a soda salt from an acrylic acid and acrylamide copolymer. Moreover, the anionic polymers may be in neutral pH medium and not only in acid pH medium. These breaking agents are neither corrosive nor toxic, which facilitates their use and limits the dangers associated with their use.

The invention also relates to a road-type coating, composed of successive layers, comprising at least one supporting layer and one bituminous layer. At least one bituminous layer linked to an inferior layer via a bonding layer provided by the process according to the invention.

The invention also refers to a machine for the construction of roadways, comprising on one frame, mounted on mobile means, spreading means of a bituminous emulsion means for the application of a surface-active agent, and means for the application of a breaking agent of the bituminous compound.

This machine thus enables the implementation of the process to obtain a bonding layer according to the invention.

BRIEF DESCRIPTION OF THE DRAWINGS

Other characteristics, objectives and advantages will be underlined by the following description, given for exemplification purposes without any limiting nature, in reference to the appended drawings, on which.

DETAILED DESCRIPTION

Figure 1:
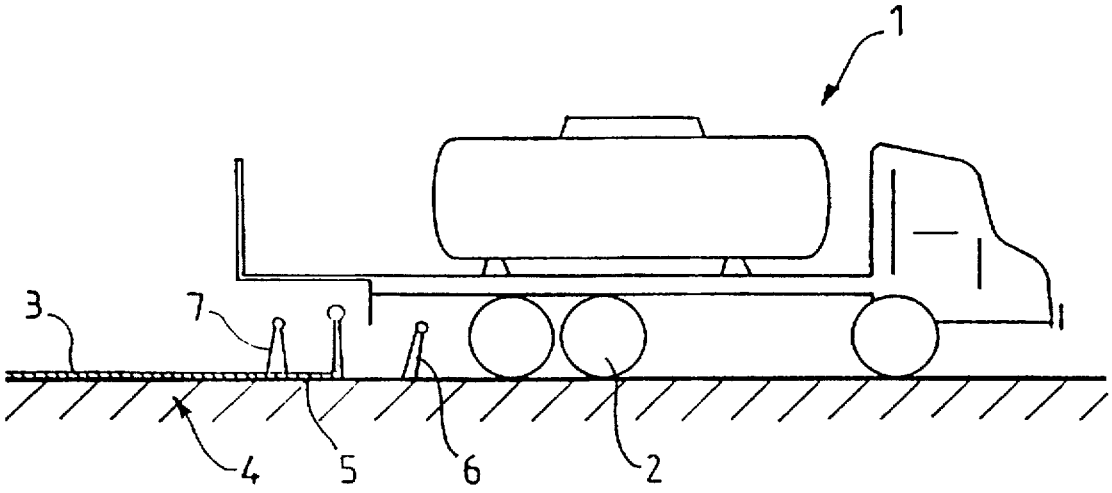
FIG. 1 represents a side view of a machine for the construction of roadways, enabling the implementation of the process according to the invention.

A machine 1 for the construction of roadways, represented in FIG. 1, is of the spreading type. The machine includes a frame, mounted on displacement means 2, spreading means 9 for a bituminous emulsion 5. This machine 1 also comprises application means 10 of a surface-active agent 6 as well as other application means 11 of a breaking agent 7 for the bituminous emulsion 5.

Figure 2:
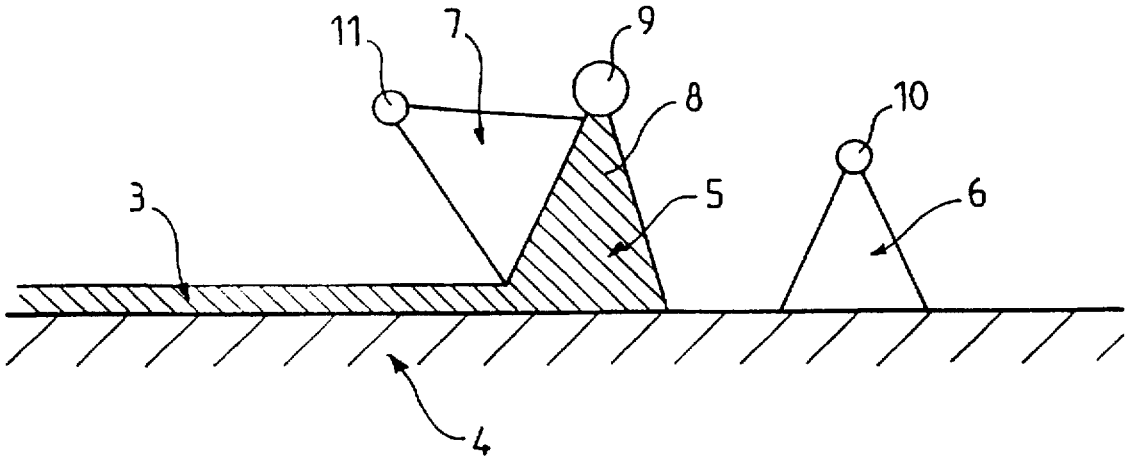
FIG. 2 represents a detail of the spreading and application means assembly fitting the machine.

The combination of means 9, 10, 11 enables the implementation of a process for obtaining a fast-setting bonding layer. This assembly is represented diagrammatically in FIG. 2. A first means of application 10, consisting of a ramp fitted with nozzles, deposits a solution containing the surface-active agent 6 on the supporting layer 4. Onto this layer 4 thus treated is spread a bituminous emulsion 5. In this example, a solution containing the breaking agent 7 is projected simultaneously onto the emulsion to form a bituminous bonding layer 3. In this case, the breaking agent 7 is applied on the stream 8 of the bituminous emulsion 5. The stream 8 of the emulsion corresponds to the product contained in the zone situated between the spreading means 9 and the ground.

The breaking agent 7 is projected onto the bituminous emulsion 5 and preferably onto the stream 8 of the emulsion. An equivalent method involves projecting the breaking agent 7 onto a section limited to the emulsion stream 8. This section could be situated in the lower half of the stream 8. The incidence angle of the breaking agent 7 can be chosen in relation to the power of the jet, the products used, and the atmospheric conditions.

Various breaking agents for carbohydrate emulsions are already known: their action generally results from a neutralization reaction or from the precipitation of the emulsified medium. The nature of the breaking agent depends essentially on the emulsified bitumen and on the emulsifying agent. In the case of a cationic emulsion, with pH greater than 1.0 and containing 60 to 75% in weight of a bituminous bonding agent and 0.1 to 0.5% in weight of a emulsifying agent such as fat amine or imidazoline hydrochloride, the breaking agent can be an aqueous solution, with concentration ranging between 5 and 35%, with a strong mineral base, such as sodium hydroxide or an anionic surface-active agent, such as a alkyl sulphate (C10–C20) or one of their mixtures. The quantity of solution of the breaking agent projected corresponds generally to 0.2 to 1% in agent weight with respect to the weight of the emulsion to be treated.

Use of a hard bitumen emulsion is preferred, with 35/50 penetration index, whose bonding content ranges preferably between 55 and 65% in weight, and with the application temperature of the emulsion ranging from 60 to 80° C.

In the following, three examples of the processes of the present invention are compared.

In these examples, the bituminous emulsion 5 contains 60% pure bitumen of class 35/60 and whose chemical formulation contains 0.3% in weight of imidazo-polyamine. The application temperature of this emulsion ranges between 60 and 80° C. The amount of this emulsion corresponds to a 1 kg/m$^2$ quantity.

The emulsion of a surface-active agent 6 is a based on alkyamido-polyamine and alkyl-imidazo-polyamine as an organic solution, with a dilution corresponding to one portion of the pure product for nine portions of water, this solution being applied at surrounding temperature and at an amount of 50 g/m$^2$.

Three breaking agent 7 solutions are used for comparison purposes. Emulsion A is a solution without any breaking agent, emulsion B is a solution with an anionic breaking agent, and emulsion C is a solution with an anionic polymer breaking agent. The breaking agent 7 solution corresponds to a dilution of one portion of the pure product for two portions of water. Application is made at surrounding temperature and at an amount of 6 g/m$^2$ of pure product.

Emulsion A fails to obtain a breaking speed of the bituminous emulsion 5 less than 15 minutes. This failure yields sticking phenomena and mediocre quality of the bonding layer thus deposited.

In the case of emulsion B, breaking takes place after 5 minutes. Still, after 5 minutes, the film deposited is slightly sticky.

In the case of emulsion C, breaking occurs within three minutes following application. After 5 minutes, the layer thus deposited is non-sticky and can be travelled on. The layer thus deposited eliminates all sticking as well as degradation phenomena. These properties are appreciated by personnel performing the method.

The process for obtaining a bonding layer using emulsion C can be performed on a wet and/or slightly dusty support, while the bonding layer maintains the aforementioned properties.

We claim:

1. A machine for the construction of roadways, comprising:

a frame;

a displacement mechanism on the frame;

a bituminous-emulsion spreader on the frame;

a surface-active agent applicator on the frame; and a breaking agent solution applicator capable of applying a solution containing the breaking agent on the frame.

2. The machine of claim 1, wherein the surface-active agent applicator is located on the frame upstream of the bituminous-emulsion spreader, and wherein the breaking agent solution applicator is located on the frame downstream of the bituminous-emulsion spreader.

3. The machine of claim 1, wherein the surface-active agent applicator is disposed on the frame such that the surface-active agent may be sprayed perpendicular to a surface supporting the machine.

4. The machine of claim 1, wherein the bituminous-emulsion spreader is capable of applying a stream of bituminous emulsion, and wherein the breaking agent solution applicator is capable of spraying the breaking agent solution into the stream of the bituminous emulsion.

5. The machine of claim 1, wherein the frame is mounted on a displacement mechanism.

6. The machine of claim 1, wherein the surface-active agent applicator comprises a ramp fitted with nozzles.

* * * * *